US005711448A

United States Patent [19]

Clarke, III

[11] Patent Number: 5,711,448

[45] Date of Patent: *Jan. 27, 1998

[54] NON-DETACHABLE TAB CAN END WITH LARGE OVAL OPENING

[75] Inventor: Milton W. Clarke, III, Chesterfield, Va.

[73] Assignee: Reynolds Metals Company, Richmond, Va.

[ * ] Notice: The term of this patent shall not extend beyond the expiration date of Pat. No. Des. 364,807.

[21] Appl. No.: 565,289

[22] Filed: Nov. 30, 1995

Related U.S. Application Data

[63] Continuation of Ser. No. 306,798, Sep. 15, 1994, abandoned.

[51] Int. Cl.[6] ..... B65D 17/34

[52] U.S. Cl. ..... 220/269; D9/438

[58] Field of Search ..... 220/269, 270, 220/271; D9/438

[56] References Cited

U.S. PATENT DOCUMENTS

| | | |
|---|---|---|
| D. 257,228 | 10/1980 | Saunders . |
| D. 364,807 | 12/1995 | Taylor . |
| D. 365,274 | 12/1995 | Cook . |
| D. 365,988 | 1/1996 | Clarke, III . |
| D. 366,832 | 2/1996 | Lo . |
| D. 371,073 | 6/1996 | Taylor . |
| 3,362,569 | 1/1968 | Geiger . |
| 3,836,038 | 9/1974 | Cudzik . |
| 3,853,242 | 12/1974 | Zundel . |
| 3,967,752 | 7/1976 | Cudzik . |
| 3,977,561 | 8/1976 | Strobe et al. . |
| 4,015,744 | 4/1977 | Brown . |
| 4,024,981 | 5/1977 | Brown . |
| 4,030,631 | 6/1977 | Brown . |
| 4,061,243 | 12/1977 | Khoury . |
| 4,062,471 | 12/1977 | Perry . |
| 4,084,721 | 4/1978 | Perry . |
| 4,184,607 | 1/1980 | Potts . |
| 4,210,257 | 7/1980 | Radtke . |
| 4,211,335 | 7/1980 | Langseder . |
| 4,219,127 | 8/1980 | Bielicki . |
| 4,266,688 | 5/1981 | Reid . |
| 4,276,993 | 7/1981 | Hasegawa . |
| 4,320,850 | 3/1982 | Drolen, Jr. . |
| 4,361,251 | 11/1982 | Langseder et al. . |
| 4,363,419 | 12/1982 | Walz, Sr. . |
| 4,367,996 | 1/1983 | Saunders . |
| 4,372,462 | 2/1983 | Dassler . |
| 4,465,204 | 8/1984 | Kaminski et al. . |
| 4,673,099 | 6/1987 | Wells . |
| 4,733,793 | 3/1988 | Moen . |
| 4,901,880 | 2/1990 | Tatham et al. . |
| 4,930,658 | 6/1990 | McEldowney . |
| 4,994,009 | 2/1991 | McEldowney . |
| 5,007,554 | 4/1991 | Hannon et al. . |
| 5,011,037 | 4/1991 | Moen et al. . |
| 5,064,087 | 11/1991 | Koch . |
| 5,129,541 | 7/1992 | Voigt et al. . |
| 5,307,947 | 5/1994 | Moen et al. . |
| 5,375,729 | 12/1994 | Schubert . |
| 5,405,039 | 4/1995 | Komura . |
| 5,555,992 | 9/1996 | Sedgeley ..... 220/269 |

FOREIGN PATENT DOCUMENTS

| | | |
|---|---|---|
| 0432659A1 | 12/1990 | European Pat. Off. . |

*Primary Examiner*—Stephen Cronin
*Attorney, Agent, or Firm*—Robert C. Lyne, Jr.

[57] ABSTRACT

An easy-open, stay-on-tab can end has a circular end wall with a large, substantially oval tear panel defined by a score line and a hinge. A rivet adjacent the tear panel connects a tab to the end wall. The width of the tear panel, as measured perpendicular to the diameter of the end wall, is substantially greater than its length. The opening formed by lifting the rear of the tab and displacing the tear panel downwardly about its hinge provides improved pourability and drinkability of the liquid contents of the can. The area of the tear panel is at least 0.50 in$^2$. The tear panel extends substantially to the center of the end wall and may include an upwardly projecting, closed, predominantly oval bead having a portion generally following the outline of the bight of the score line. The front end of the tab extends over the bead and cooperates with it during opening.

12 Claims, 3 Drawing Sheets

NON-DETACHABLE TAB CAN END WITH LARGE OVAL OPENING

RELATED APPLICATION

This application is a continuation of application Ser. No. 08/306,798, filed Sep. 15, 1994 now abandoned, and is related to co-pending application Ser. No. 08/533,039, which is a division of that application, and is also related to my co-pending design patent application Ser. No. 29/024,577, filed Jun. 15, 1994 and issued Jan. 9, 1996 as U.S. Pat. No. Des. 365,988 now abandoned.

TECHNICAL FIELD

The present invention relates generally to end members of beverage containers, and, more particularly, to an easy-open, stay-on-tab (SOT) can end in which an attached tab is lifted to partially sever and displace a scored tear panel, thereby creating a pouring or drinking opening, with the tab and tear panel remaining attached to the end.

BACKGROUND ART

Aluminum or steel cans, typically filled with beer, soft drinks, tea, juice, water, concentrate, or the like, are provided with an easy-open, stay-on-tab can end wherein a non-closed score line is formed in the end and the tab is secured to the end at a location immediately outside a portion of the score line by a fastener such as a rivet. In this type of end, the tab is hingedly connected to the rivet. In operation, a force is supplied by the tab and through the hinge association with the rivet to the scored tear panel portion of the can end to initially rupture the score line. The continued application of force pushes the tear panel down into the container. The non-closed portion of the score line retains the scored tear panel with the end and the tab remains attached by the rivet to remain with the end.

To facilitate a better understanding of the invention in the description which is to follow, the location of various parts of the tab, tear panel, and score line on the end will be identified by reference to clock positions. As used in this specification, and assuming that the end is held in a vertical plane with the tear panel located beneath the stay-on-tab, the 12:00 position is located above the tab along a longitudinal axis extending through the rivet to bisect the tab. The 6:00 position is located along the same axis below the tear panel, with the 3:00 and 9:00 positions being located to the right and left of the end, respectively, along an axis extending perpendicular to the aforementioned longitudinal axis.

Certain types of failure sometimes occur when attempting to open the end. One type of failure is called "nose failure", wherein the initial opening action of the tab fails to "pop" the score line.

Another type of failure is called "non-turnunder", which means that the rupture of the score line fails to propagate fully around the tear panel and instead gets only to a point, usually at about the 3:00 position, where the tab starts slipping and bends the metal of the partially opened tear panel metal down so that the tab then slips off the tear panel and becomes useless.

Another problem concerns the opening of the tear panel through an insufficient angle, which means that the tear panel fails to completely swing down through about 80° to 90° from its original position so as to avoid blocking the opening. When this problem occurs, the tear panel swings down incompletely, i.e., typically only 30° to 40° from the plane of the can end, and therefore partially restricts the free flow of liquid through the opening.

The foregoing non-turnunder and insufficient angle problems generally occur as a result of an inability of the tab to act on the tear panel in a manner which creates a sufficiently pure shear force to fracture the score line and then continue to apply sufficient shear to propagate the score line completely around the tear panel. These problems become exacerbated as larger openings are formed within can ends for either aesthetic reasons or to ensure greater pourability and drinkability. As used in this specification, a "larger opening" is an opening area defined by the tear panel in the range of approximately 0.5–0.75 square inch, which has been found desirable in can ends having a diameter in the range of about 202–211, using can makers' conventional terminology. A "standard size opening" is one having an area less than about 0.5 square inch and is typically within the range of 0.40–0.47 square inch. Within the context of the larger opening, it will be appreciated that the geometry and longer path lengths of the tear panel necessitate a greater need to ensure proper creation and transmission of shearing forces to the score line throughout the entire opening process, and it is this consideration to which the present invention is directed. It should also be appreciated that the present invention may be used for a wide range of sizes of can ends, including 200–300.

It is accordingly an object of the present invention to control the shearing action induced by the tab against the tear panel along the score line to ensure complete rupturing of same except in the area of the hinge.

Another object is to control the application of the shearing force acting on the tear panel as a function of the propagation of the rupture of the score line.

A further object is to facilitate the use of larger size openings in beverage container ends without encountering the problems of non-turnunders and insufficient angles.

SUMMARY OF THE INVENTION

The present invention provides a stay-on-tab container end or lid wherein the score line defining the severable tear panel portion tears correctly and completely, except at a hinge portion thereof, so that the tear panel is opened and remains on the end. The tab and tear panel are structured to cooperate in a unique manner whereby multiple and changing points of contact between these parts during tab opening movement serve to generate shearing forces acting to rupture the score line, instead of tension forces which would disadvantageously bend the tear panel and result in non-turnunder or insufficient angle.

In the preferred embodiment of the invention, a stay-on-tab can end is formed with an end wall and a rupturable score line in the end wall defining most of the periphery of a non-removable tear panel, while leaving an integral hinge between the panel and the remainder of the end wall. The score line extends away from one end of the hinge, around a bight where it is distant from the hinge, and back to the other end of the hinge. A tab extending generally parallel and close to an underlying area of the end wall has a rear part which is manually engageable for upward lifting and a forward nose part overlying a minor portion of the tear panel. Attaching means are provided on the end wall in a region thereof adjacent the score line and outside the tear panel. The attaching means is non-detachably secured to connecting means on the tab. The attaching and connecting means permit pivotal movement of the tab when the rear part of the tab is partially lifted up from the container and while the forward nose end of the tab correspondingly swings down, whereby the score line is subject to initial rupture. In accordance with the invention, a bead is formed to project upward from the tear panel upper surface while extending beneath the forward nose part of the tab. Continued pivotal movement of the tab, about an axis of rotation generally parallel to the underlying area of the end wall and close to the attaching means, is effective to propagate the rupture of the score line from the 12:00 position and to swing the panel down about its hinge to the open position, by creating a second point or place of contact between the bead and the forward nose part of the tab. This second contact is spaced from the longitudinal axis of the tab and is located on the side of that axis where the propagation of rupture away from the rivet is to occur (i.e., the side of the longitudinal tab axis opposite the side where the tear panel is hinged to the rest of the wall of the end).

Directional terms used in this application will assume that the can end is oriented on an can standing upright with the pour opening toward the viewer. Thus, the tab is above the end wall, the longitudinal axis of the tab extends through the rivet, the length of the tab is along that axis, the width of the tab is perpendicular to that axis, the front of the tab is toward the viewer, and the rear of the tab is away from the viewer. The "length", "width", "front", and "rear" of the tear panel and the bead refer to the same directions as those of the tab, so that the lengths of the tear panel and bead lie along a diameter of the end wall and their widths lie along a chord of the end wall.

In the preferred embodiment, the opening defined by this score line is a large opening, having an area greater than 0.5 square inch in a container end having a size within the nominal range of 202–211.

Conventionally a purpose of the bead in the tear panel is to take up slack in the metal created by scoring. In addition, the bead is preferably continuous in the portion of the tear panel underneath the tab, in order to give the tear panel added rigidity transverse to the longitudinal axis of the tab. Thus, the tendency of the tear panel to bend across that axis is minimized, which helps to facilitate the transmission of shear force to the score line. Moreover, by providing the bead beneath the tab and by providing two spaced points or places of contact of the tab with the bead, there tends to be a more uniform distribution of the tab load against the tear panel. In the preferred embodiment, and these two points of contact are separate from the point of contact between the center of the nose of the tab with the tear panel. The height of the bead is 0.011 inch, measured from the top surface of the flat portion of the tear panel. It is theorized that once the tab also contacts these side points on the bead, relative to the center of the nose, the rupture of the score line is able to better propagate as a result of the tab having the aforesaid at least two points of contact with the bead. Preferably, in top plan view, the bead is formed in curvilinear, eyeball shape and generally follows the outline of the score. Its lens-like protuberance extends beneath the forward nose part of the tab. The protuberance preferably has substantially the same cross-sectional depth profile as the remainder of the bead and projects sufficiently upward from the surrounding upper surface of the end wall to provide the aforesaid points of contact with the tab.

The attaching means preferably comprise a rivet integrally formed in about the center of the end wall. A coined area is surrounds around the rivet. This coined area has a diameter of 0.358 inch. The thickness of the metal in the coined area is 0.009 inch. The rivet hole in the tab has a diameter of 0.130 inch. The score line extends through this coined area; however, the aforementioned second point of contact is preferably located outside the coined area.

Preferably, the protuberance is closest to the rivet at the 12:00 position and may be symmetric about the 12:00–6:00 axis.

The place on the tear panel where the forward nose part of the tab initially presses is spaced from the bead as well as from the score line. The rivet is close to the score line. The second point of contact is closer to the 3:00 position than the point of initial pressing to transmit the application of shear force to the rupturing score line as the rupture travels proximate the 3:00 position. (Of course, the score could be reversed about the longitudinal axis of the tab, in which case this would occur with reference to 9:00 rather than 3:00, but for purposes of clarity and consistency in this description clockwise propagation will be assumed.)

A further point of contact between the nose part and the bead, which is located closer to the hinge than the point of contact between the center of the nose and the tear panel, is utilized to transmit shear force to the score line as it travels to its end position (about 10:00–11:00) to thereby ensure complete opening of the tear panel.

Other details, uses and advantages of this invention will become apparent as the following description of the exemplary embodiments thereof presented in the accompanying drawings proceeds.

BEST MODE FOR CARRYING OUT THE INVENTION

Figure 1:
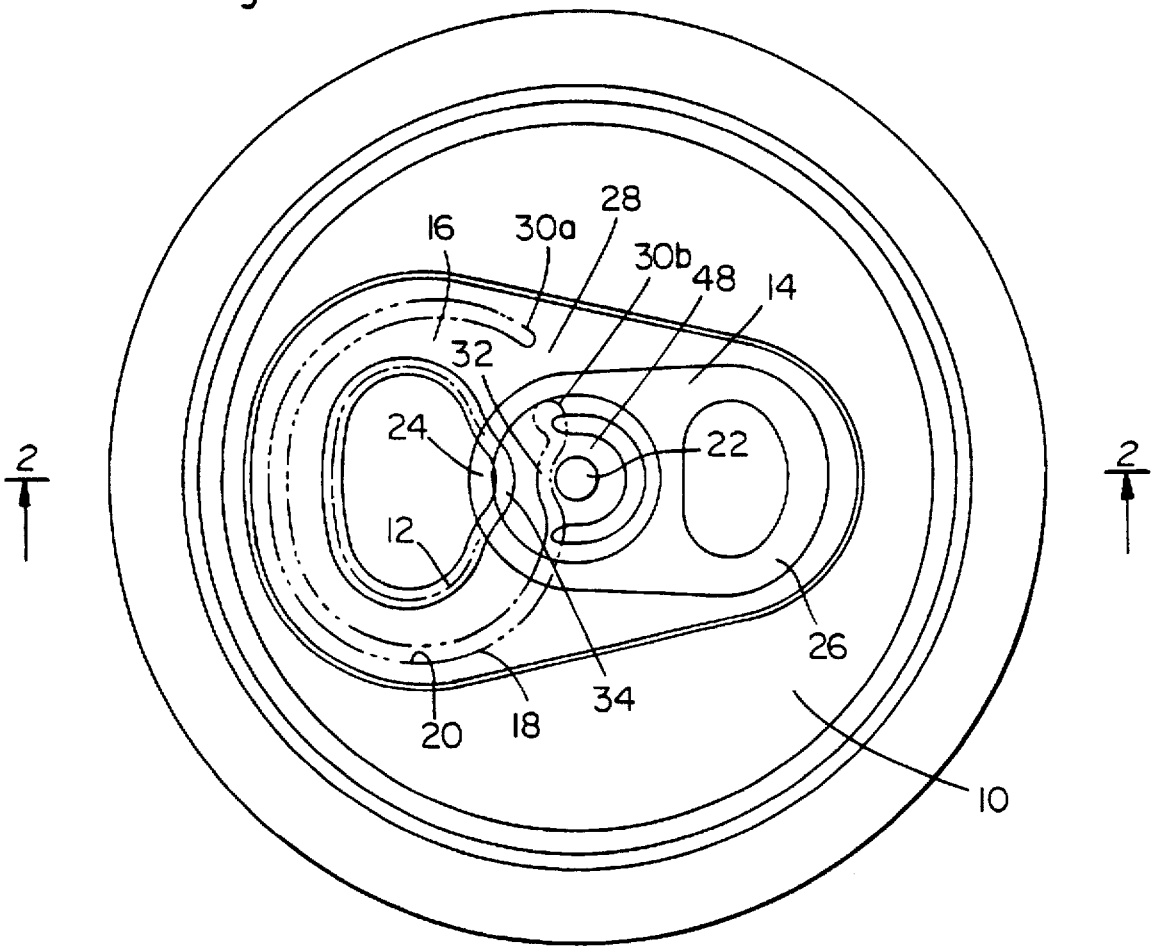
FIG. 1 is a top plan view and scaled representation of the container end wall in accordance with a preferred embodiment of the present invention.

FIG. 1 is a top plan view illustration of an exemplary embodiment of an easy-open top end wall 10, which is made in accordance with the teachings of this invention, for securement to a container side wall (not shown) in a known manner. The remainder of the container, which is typically a 12 oz. metal beverage can, may be of any suitable conventional construction that includes a bottom wall joined to a substantially cylindrical side wall, either as a single or two-piece construction. In the preferred embodiment, as discussed more fully below, the invention features a uniquely shaped bead, which is generally designated with reference numeral 12 and which, under the opening action of a tab 14, ensures that a non-removable tear panel 16 is properly severable from the wall along its entire score line 18 to define an opening 20 through which container contents may be properly dispensed.

Figure 2:
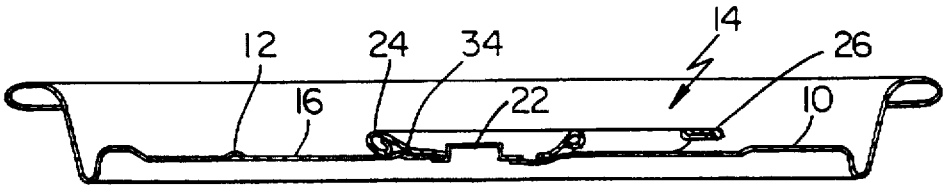
FIG. 2 is a cross-sectional scaled representational view taken along the line 2—2 of FIG. 1.
Figure 3:
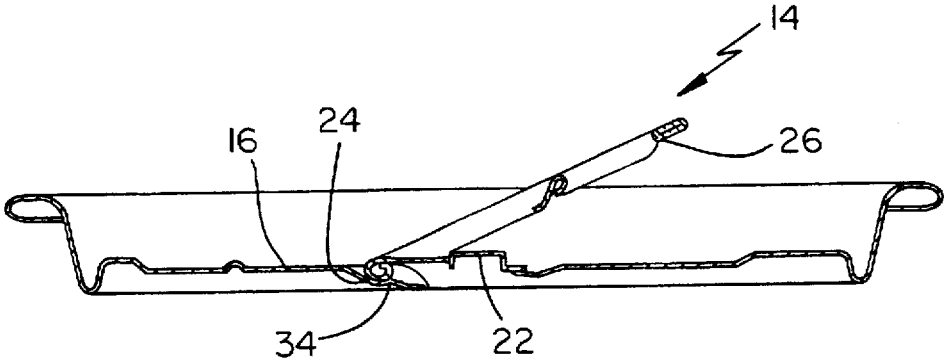
FIG. 3 is a view similar to FIG. 2 showing the tab in initially raised position to rupture the score line of the tear panel.

In more detail, and with particular reference to FIGS. 1 and 2, the top end wall 10 has formed therein the score line 18 which defines most of the periphery of the non-removable tear panel 16. The tab 14 is attached to wall 10 in a non-detachable manner with a rivet 22 as taught, for example, in U.S. Pat. No. 3,967,752 to Daniel F. Cudzik, assigned to Reynolds Metals Company, Richmond, Va., the assignee of the present invention. The '752 patent is incorporated by reference herein. The tab 14 has a forward portion terminating in a nose 24 and overlaying only a minor part of panel 16, at the 12:00 position as shown, and tab 14 has a rear portion 26 on the opposite side of rivet 22 which is adapted to be easily grasped and lifted to urge nose 24 downwardly against the top surface of panel 16 to initially move the panel downward relative to rivet 22 and the remainder of wall 10 (FIG. 3) with a wall portion 28 located between opposite ends 30*a*, 30*b* of score line 18 holding the panel securely thereto and defining a bend area or integral hinge between the panel and the remainder of the end wall. The length of this hinge 28 is substantially less than the maximum dimension of the tear panel 16 as is well known.

The score line 18 extends in a continuous curvilinear path and terminates in what will be referred to as spaced ends 30*a* and 30*b*. The score line 18 has an undulating or curved portion 32 located between rivet 22 and nose 24 to define the area in which initial tearing of the score line and panel will occur (FIG. 4A) as the previously mentioned tab rear portion 26 is lifted upwardly so as to pivot nose 24 downwardly for pressing engagement with the tear panel. This initiates shearing action along the score line to rupture or sever the panel beginning from end 30*b* as discussed more fully below.

The preferably closed reinforcing bead 12, in top plan view, extends in an elliptical or oval configuration wherein the long or major axis is in the 3:00–9:00 (lateral) direction of the opening 20. However, in accordance with a unique feature of this invention described more fully below, the portion 34 located closest rivet 22 bulges away from the remainder of the elliptical portion, and toward the rivet, to produce an eyeball-shaped bead in which the "lens" is a protuberance 34. In the vertical cross-sectional depth direction, the bead 12, including the protuberance, extends in an axially outward or upward direction from the severable tear panel 16 and preferably has the same cross-sectional depth dimensions along its entire extent.

In the preferred embodiment, it will be further seen that the bead 12, with the exception of protuberance 34, has a configuration generally similar to that of score line 18 excepting ends 30*a*, 30*b* and curved portion 32 located proximate rivet 22.

FIGS. 4A through 4F show tab 14 and tear panel 16 as opening of the can end progresses, as a result of the continued lifting of the rear of the tab, which causes the tab's nose to rotate downward about the tab's axis of rotation.

Figure 4A:
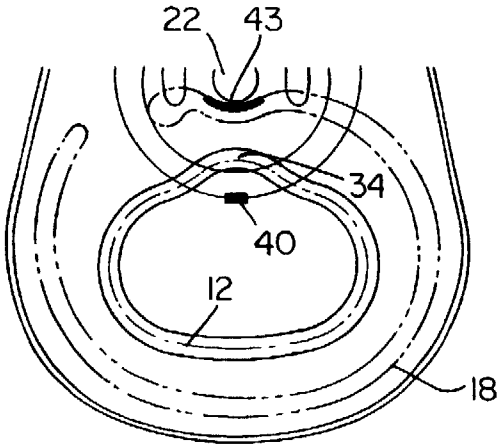
FIGS. 4A–4F are sequential action views detailing the progressive rupturing of the score line to completely open the tear panel.

With reference to FIG. 4A, the center of tab nose 24 contacts the tear panel at a point or place 40 located beyond the protuberance 34 of bead 12 (i.e., on the opposite side of bead 12 from rivet 22). This initial point of contact 40 creates initial tearing 43 of score line 18 about rivet 22 in the 12:00 position of the score. This initial tearing is the "pop" referred to above.

Figure 4B:
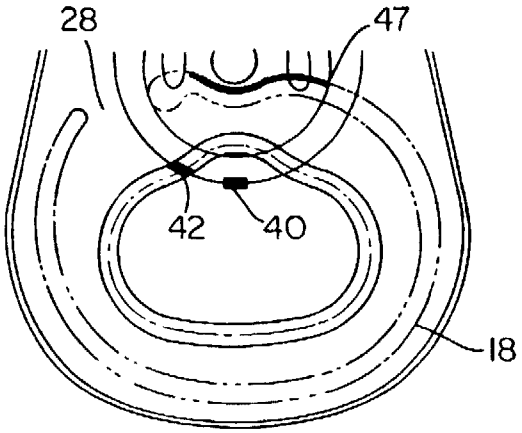

Continued lifting of the rear of tab 26 creates point of contact 42 at the intersection of another portion of the tab with bead 12, as shown in FIG. 4B. The rupture of the score line 18 now begins to propagate clockwise from its initial tear 43 near rivet 22.

Figure 4C:
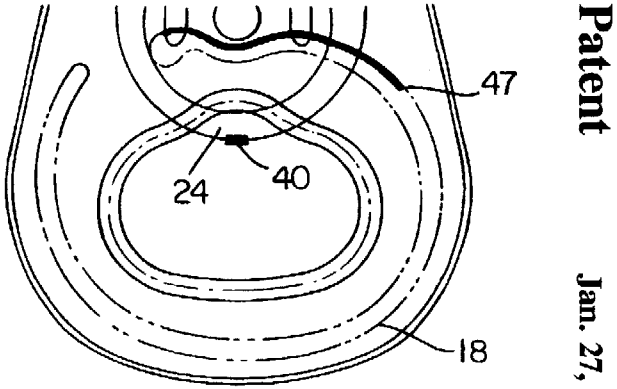

As lifting of the rear of the tab continues, the contact point 42 between bead 12 and the tab is released as a result of relative vertical displacement, at the ruptured part of the score line, of the tear panel 16 with respect of wall 10. The tear panel 16 is now being pushed down under the shearing load transmitted to it by the tab nose 24 at point of contact 40, as best depicted in FIG. 4C. Therefore, in FIG. 4C, the tear panel is beginning to open in a normal manner under the aforementioned shearing load action as the score begins to propagate toward the 3:00 position.

Figure 4D:
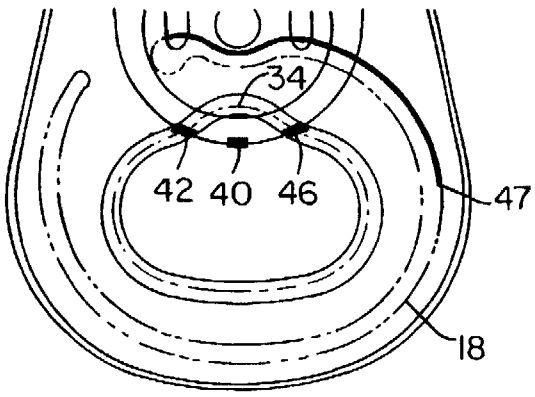

As the score line 18 rupture begins to propagate to approximately the 3:00 position as depicted in FIG. 4D, the feature of protuberance 34 reestablishes point of contact 42 with the tab while further establishing point of contact 46 which is located closest to the end 47 of the advancing score line rupture, which in FIG. 4D is located at 3:00. As a result of this additional point of contact 46, in preferred combination with points of contact 40 and 42, it is theorized that the downward load of the forward portion of the tab is converted from a bending load which would otherwise disadvantageously bend the tear panel 16 to create a non-turnunder, into a load which now results in a shearing action or load force located closer to the advancing rupture of the tear line at 3:00.

This shearing force is believed to be the result of at least several factors. First, the distribution of the load on the tear panel over multiple points or places of contact reduces the tendency of the tear panel to bend about the longitudinal axis of the tab. Second, the multiple contacts create a second class lever having its fulcrum at point 42, its input force at points 40 and/or 46, and its load at the score line in the 3:00 area. Third, any looseness or slack in the metal of the tear panel is taken up by bending occurring within the confines of the bead, where the nose of the tab is deforming the metal, rather than outside the bead; put another way, this "good" bending inside the bead serves to tension the metal of the tear panel and store in it energy which will soon be released suddenly and explosively to propagate the rupture of the score line. It should be noted that such bending requires contact between the tab nose and the metal of the tear panel inside the bead. Contact of the tab nose only with the bead would not accomplish it. Thus, it is believed that contact of the tab nose with the bead (e.g, at points 42 and/or 46) provides the necessary mechanics and leverage, while contact of the tab nose with the metal inside the bead provides, either alone or in conjunction with the bead contact or contacts, the necessary tensioning and energy storage. In any event, the tear strip reliably continues to rupture past the 3:00 position during further tab rotation to about the 9:00 position as depicted in FIG. 4E.

Figure 4E:
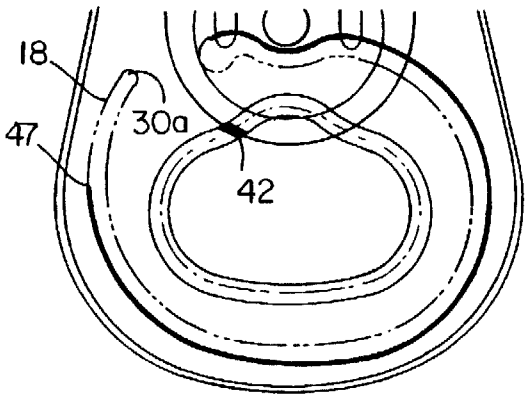

In FIG. 4E, since the tear has now advanced to the 9:00 position, points of contact 40 and 46 are now relieved as a result of downward displacement of tear panel 16. The remaining point of contact 42 at the intersection of nose 24 with protuberance 34 is advantageously located to ensure that proper shearing action is applied to score line 18 to enable it to completely rupture up to end 30*a* proximate hinge portion 28 as 10 well as being completely depressed downwardly into the can interior towards a 90° or vertical position. It should be noted that in going from FIG. 4D to FIG. 4E the input force of the theoretical second class lever has shifted from 46 (or some combination of 42, 40 and 46) to 42 only, and that the fulcrum has shifted from 42 to hinge 28. Thus as propagation progresses the distance between the fulcrum and the load at the end of rupture propagation has increased, while the distance between the fulcrum and the input force has decreased. This is advantageous, since at 3:00 maximum shearing force at the score line is the prime consideration, and after 3:00 maximum downward movement of the tear panel at the score line becomes the prime consideration.

Figure 4F:
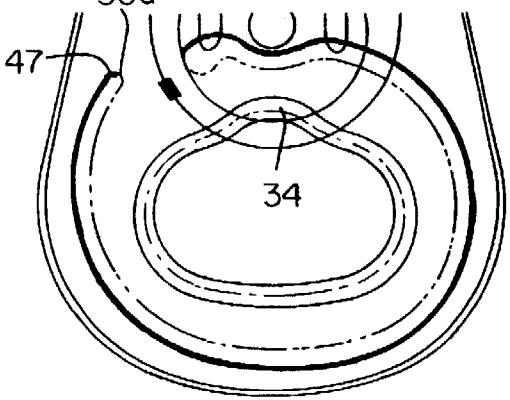

As the final tear occurs in FIG. 4F (at which point the tear strip is fully depressed downward into the aforesaid 90° position) the final point of contact between the tab nose 24 with the tear panel 16 begins to slide back towards the hinge 28.

In a can end having a nominal 206 diameter (using can maker's conventional terminology), and generally speaking within the range of 200–300 diameters, the area of the standard opening is in the range of 0.42–0.475 square inch. Although not strictly necessary, the invention as described above is suitable for use in can ends having the aforementioned conventionally sized standard opening areas. However, in the preferred embodiment, the invention has particular preferred use in large can ends having score lines 18 defining large openings 20. As used in this specification, a large opening is considered to have an area of about between 0.5–0.75 square inch, and preferably about 0.65–0.67 square inch. As disclosed herein, they may have their major axis perpendicular to the longitudinal axis of the tab and their minor axis perpendicular to that axis, with the major axis being greater than the width of the tab. Within the environment of such large openings, the additional mechanical advantage provided by points of contact 40, 42 and 46, in particular 46, is what enables the tear line to propagate past the 3:00 position in FIG. 4D so as to result in proper and full opening as depicted in FIG. 4F.

In a further aspect of the preferred embodiment, the protrusion 34 is preferably located radially outwardly from an area of coining 48 which is typically formed around the periphery of rivet 22 during the manufacturing process. It is theorized that since the metal in the coined area is relatively brittle better shearing action results when the protuberance 34 and particularly points of contact 42 and 46 therewith are located outside of this coined area 48.

Although a protuberance 34 constitutes the presently preferred embodiment, it will be understood by one of ordinary skill in the art that other bead shapes may be utilized, including bead shapes which may not necessarily be entirely closed or symmetrical about the longitudinal axis of the tab, so long as such other bead shapes will result in the multiple points of contact 40, 42 and 46 with the shearing and leverage forces generated thereby as discussed above. However, it is further theorized that a closed bead is preferred since it tends to maintain the tear panel 16 flat and does not allow it to cave or buckle in during opening.

Moreover, while the desired contact between the tab and the tear panel during opening, and particularly the stage depicted in FIG. 4D, has been determined primarily by the outline of the bead as viewed from the top (e.g., FIGS. 1, 2, and 4A–4F) and the height of the bead as viewed in side cross section (e.g., FIG. 3), it will be appreciated that the configuration of the tab nose as viewed from the top and side can also be modified to achieve the desired contact pattern in the progression of the opening process. A conventional tab has been disclosed in this application, but the tab nose could be designed to have a non-circular shape or may have downward projections.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A metal easy-open can end with non-detachable means for making an opening therethrough suitable for pouring and drinking, the can end having a circular end wall, a rupturable score line in the end wall defining most of the periphery of a non-removable tear panel, while leaving between the tear panel and the remainder of the end wall an integral hinge whose length is substantially less than the maximum dimension of the tear panel, the score line extending away from one end of the hinge, around a bight where it is distant from the hinge, and back to the other end of the hinge, and the tear panel having its length lying on a diameter of the circular end wall, a tab extending generally parallel and close to an underlying area of the end wall, a rear part of the tab being engageable for upward lifting, and a forward part of the tab terminating in a nose at its front end, and a rivet located on said diameter and adjacent the score line, which rivet non-detachably connects the end wall to the tab and permits pivotal movement of the tab about an axis of rotation close to the rivet and generally parallel to the end wall when the rear part of the tab is lifted up from the end wall, whereby, when the rear part of the tab is lifted, the forward part of the tab is adapted to press down on the tear panel, so as to cause relative vertical movement between the tear panel and the rivet, initial rupture of the score line close to the rivet, propagation of the rupture away from the hinge, around the bight, and back to the hinge, and swinging of the tear panel down about the hinge to an open position, wherein the improvement comprises the tear panel, and hence the opening for pouring and drinking, which (a) has substantially the shape of an oval, (b) has its width, as measured perpendicular to said diameter, substantially greater than its length, (c) has an area greater than 0.5 $in^2$, and (d) extends substantially to the center of the circular end wall.

2. The can end of claim 1, wherein a major portion of the score line is elliptical.

3. The can end of claim 1, wherein the tear panel is, at least at the portions of its boundary other than the hinge and adjacent the rivet, oval.

4. The can end of claim 1, wherein the tear panel includes an upwardly projecting, closed bead having a portion generally following the outline of the bight of the score line.

5. The can end of claim 4, wherein a major portion of the bead is oval.

6. The can end of claim 4, wherein the bead passes between the nose of the tab and the rivet.

7. The can end of claim 6, wherein the bead is generally shaped like a horizontal cross-section of an eyeball whose lens projects toward the rivet.

8. The can end of claim 4, wherein the forward part of the tab and the tear panel are configured so that, after the nose of the tab has pressed down on the tear panel at an initial place of contact and caused the rupture to propagate from the rivet approximately 90° to the region of the width of the tear panel which is farther from the hinge, the forward part of the tab is adapted to press down on the bead at an offset place of contact which is laterally spaced from the nose of the tab and from said initial place of contact and is closer to the end of the rupture than said initial place of contact is, so that the downward force at said offset place of contact will create an increased, leveraged shearing force on the score line at the end of the rupture.

9. The can end of claim 8, wherein the bead passes between said initial place of contact and the rivet, so as to allow the nose of the tab to tension the flat metal of the tear panel enclosed by the bead.

10. The can end of claim 8, wherein the forward part of the tab presses on the tear panel simultaneously at said initial place of contact and said offset place of contact.

11. The can end of claim 8, wherein the shearing force is created by a second class lever, the lever having an input force at said offset place of contact, a load at the end of the rupture, and its fulcrum at a second offset place of contact on the tear panel which is closer to the hinge than said initial place of contact is.

12. The can end of claim 11, wherein, after the rupture has propagated from the rivet approximately 90° to said region of the width of the tear panel which is farther from the hinge, continued lifting of the rear part of the tab causes further propagation of the rupture from said region approximately 180° to the opposite region of the width of the tear panel, thereby shifting the input force of the second class lever from said offset place of contact to said second offset place of contact on the tear panel and shifting the fulcrum of the lever from said second offset place of contact to the hinge.

* * * * *